US006529703B2

(12) United States Patent
Kawasumi et al.

(10) Patent No.: US 6,529,703 B2
(45) Date of Patent: Mar. 4, 2003

(54) IMAGE FORMING APPARATUS HAVING REGISTRATION ROLLERS OF A VARIABLE ROTATING SPEED

(75) Inventors: Ryoichi Kawasumi, Ibaraki (JP); Akinori Tanaka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/957,237

(22) Filed: Sep. 21, 2001

(65) Prior Publication Data

US 2002/0039507 A1 Apr. 4, 2002

(30) Foreign Application Priority Data

Sep. 29, 2000 (JP) ..... 2000-298419
Nov. 20, 2000 (JP) ..... 2000-352404

(51) Int. Cl.[7] ..... G03G 15/00
(52) U.S. Cl. ..... 399/388; 399/395; 399/396
(58) Field of Search ..... 399/388, 394, 399/396; 271/242, 264, 265.01, 265.02

(56) References Cited

U.S. PATENT DOCUMENTS 5,119,146 A * 6/1992 Nobumori et al. ..... 271/265.02
6,148,172 A * 11/2000 Kanda et al. ..... 271/242
6,397,035 B2 * 5/2002 Kataoka et al. ..... 399/388

FOREIGN PATENT DOCUMENTS

JP 09-244316 * 9/1997

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image forming portion for forming an image on a sheet. A separating and feeding portion feeds sheets stacked on a sheet supporting portion one-by-one toward the image forming portion. A sheet conveying portion conveys the sheets fed by the separating and feeding portion. Registration rollers of a variable rotating speed are disposed upstream of the image forming portion with respect to a sheet conveying direction. A sheet conveyance controlling portion causes the registration rollers to effect the conveyance of the sheets at a speed higher than the image forming speed in the image forming portion. Thereafter, the registration rollers are decelerated so as to assume substantially the same speed as the image forming speed at a timing earlier than a latest image forming timing in the image forming portion.

11 Claims, 11 Drawing Sheets

IMAGE FORMING APPARATUS HAVING REGISTRATION ROLLERS OF A VARIABLE ROTATING SPEED

BACKGROUND OF THE INVENTION

1. Field of the Invention

This invention relates to an image forming apparatus such as a copier, a printer or a compound machine having also the function of these, and particularly to the sheet conveyance control by registration rollers disposed upstream of image forming means for forming an image on a sheet.

2. Description of the Prior Art

In an image forming apparatus such as a copier, the productivity and the quality of image of the apparatus are very important specifications, and in recent years, higher productivity and a higher quality of image have been required. The first copy time (hereinafter referred to as the Fcot) from the start of image formation on the first sheet till the end of the image formation is also a very important specification, and the shortening of the Fcot is required of the apparatus.

To increase the productivity and shorten the Fcot, it is usual to increase the image forming speed of the image forming apparatus. However, when the image forming speed is increased, the driving load, the rotating speed, etc. of each portion of the apparatus rise and therefore, a countermeasure such as increasing the rigidity of each portion of the apparatus becomes necessary and as the result, there arises the problem that the apparatus becomes bulky or the costs of parts and the production cost rise.

Also, regarding digital copiers and printers which have been rapidly spreading in recent years, when the image forming speed is increased, the number of revolutions of a polygon mirror which is the writing portion of a laser must be made very high. Therefore there may arise the problem that the cost of the polygon mirror becomes very high or the image is deteriorated because the rotation of a motor is not stable. There is also used the technique of restraining the number of revolutions of the polygon motor and using a plurality of writing lasers, but again this technique gives rise to the complication of the apparatus and the complication of and an increase in electrical parts. Further, in this case, in order to realize a higher quality of image, there arises the necessity of the high accuracy of many parts typified by the parts of an optical system, and this results in a great rise of production cost.

Therefore, in order to obtain the maximum productivity of the apparatus for the image forming speed, there has heretofore been used the technique of reducing the conveyance interval of sheets during image formation (during image transfer) as far as possible.

However, with regard to registration rollers provided upstream of image forming means, the time for ramming a sheet against the stopped registration rollers to thereby form a loop becomes necessary in order to effect the correction of the skew feeding of the sheet, and it is necessary to widen the conveyance interval of sheets by this loop forming time.

There is also seen an apparatus in which the control of changing the speed for conveying sheets is effected and the conveying speed is changed so as to convey the sheets at a speed higher than the image forming speed in the sheet conveying path from a sheet containing portion such as a sheet cassette to registration rollers to thereby realize the narrowing of the sheet conveyance interval. In such an apparatus, there is often seen a case where conveying rollers are driven by a stepping motor, but the vibration of the stepping motor for driving may cause the vibration of a laser unit or an optical unit and further, even image forming means and as the result, the deterioration of copy images may arise as another problem. Further, when the conveying speed is to be changed over, the pulse of the stepping motor is changed, but again at this time, the vibration of the stepping motor occurs and conceivably, the vibration of the sheet and the vibration of a conveyance driving unit affect image formation.

SUMMARY OF THE INVENTION

So, the present invention has as its object to provide a sheet conveying apparatus designed such that the control of changing the speed for conveying a sheet is effected by registration rollers and that the vibration of the sheet and the vibration of a motor for driving conveying rollers are not transmitted to image forming means and transferring means, and an image forming apparatus having the same.

The present invention is an image forming apparatus comprising:

- image forming means for forming an image on a sheet;
- separating and feeding means for feeding sheets stacked on sheet supporting means one by one toward the image forming means;
- sheet conveying means for conveying the sheets fed by the separating and feeding means;
- registration rollers of a variable rotating speed disposed upstream of the image forming means with respect to a sheet conveying direction; and
- sheet conveyance controlling means for causing the registration rollers to effect the conveyance of the sheets at a speed higher than the image forming speed in the image forming means, and thereafter decelerating the registration rollers so as to assume substantially the same speed as the image forming speed at timing earlier than latent image forming timing in the image forming means.

DESCRIPTION OF THE PREFERRED EMBODIMENTS

Figure 1:
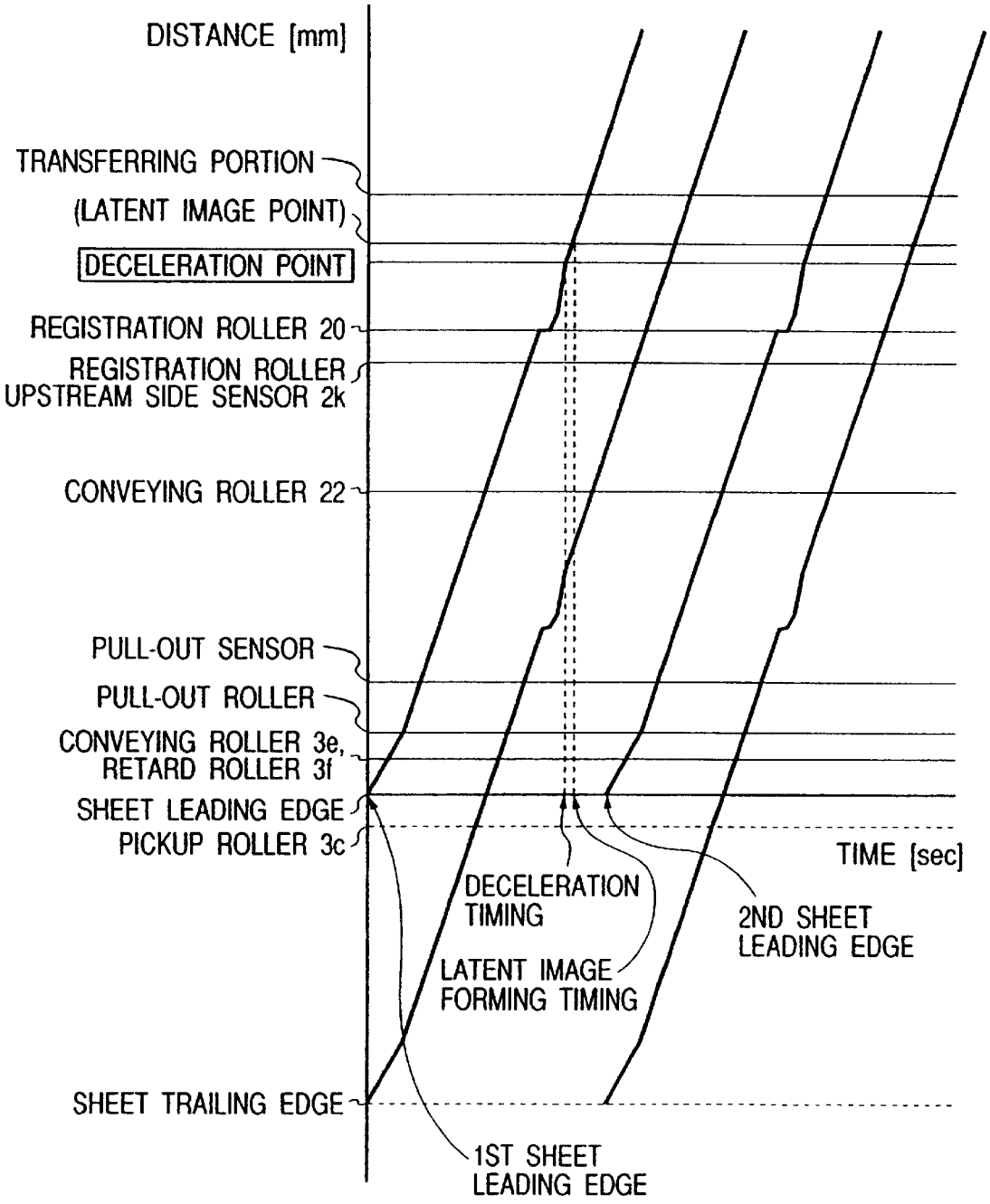
FIG. 1 is a sheet feeding diagram of an image forming apparatus according to a first embodiment of the present invention.

Some preferred embodiments will hereinafter be described in detail with reference to the drawings. However, the dimensions, materials, shapes and relative disposition of constituent parts described in these embodiments are not intended to restrict the scope of the present invention thereto unless specifically described.

(First Embodiment)

This embodiment will be described with respect to a copier adopting the electrophotographic process as an image forming apparatus. The general construction of a copier according to the present embodiment will first be described with reference to FIG. 3.

The copier is provided with image forming means 2 for forming an image on a sheet S, a plurality of rollers constituting sheet conveying means, registration rollers 20 of a variable rotating speed disposed upstream of the image forming means 2, and a controller 100 as sheet conveyance controlling means.

The rollers constituting the sheet conveying means include not only conveying rollers 22 upstream of the registration rollers 20, but also a pickup roller 3*c* as the separating and feeding means of a feeding portion 3 for feeding stacked sheets S one by one, a conveying roller 3*e* and a retard roller 3*f*.

A registration roller upstream side sensor 2*k* as registration roller upstream side sheet detecting means is disposed near and upstream of the registration rollers 20.

The controller 100, when it rams the sheet S against the registration rollers 20, and thereafter effects the conveyance of the sheet S at a speed higher than the image forming speed at predetermined sheet conveyance timing after the detection of the sheet by the registration roller upstream side sensor 2*k*, and thereafter effects the control of the speed of the registration rollers 20 at predetermined sheet deceleration timing so as to become substantially equal to the image forming speed, and controls the sheet deceleration timing so as to be earlier than latent image forming timing in the image forming means 2.

Figure 3:
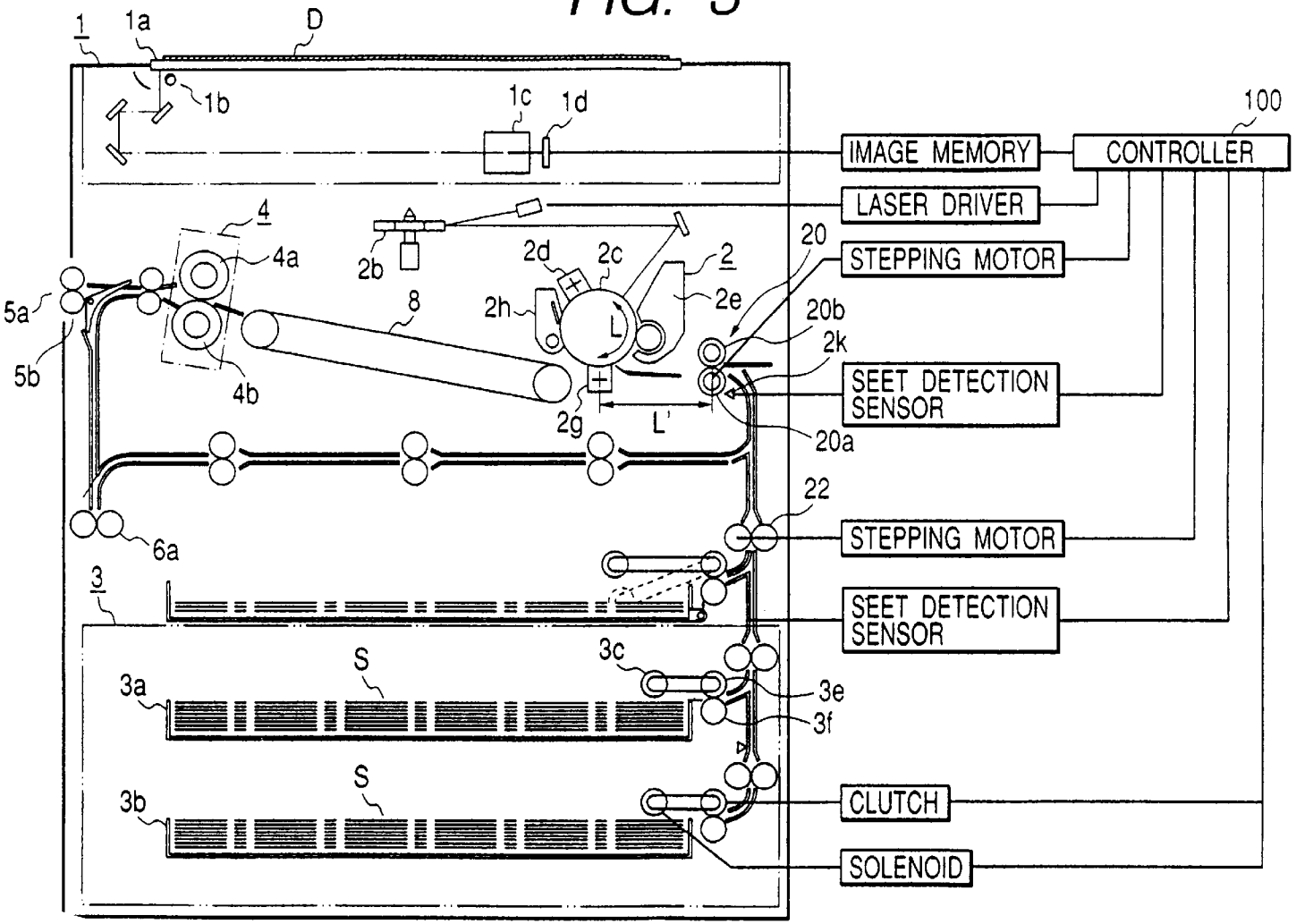
FIG. 3 shows the general construction of the image forming apparatus controlled along the diagram of FIG. 1

In FIG. 3, the copier photoelectrically converts image information read by a reader portion 1 having a running optical system and transfers it to the image forming means 2, and in the image forming means 2, image formation is effected on the sheet S fed by the feeding portion 3. After the image formation, the sheet S is conveyed to a fixing portion 4, where heat and pressure are applied thereto and a transferred image is fixed. The processes until the image is formed and the sheet is discharged will hereinafter be successively described.

First, in the reader portion 1, light is applied to an original D placed on an original glass stand 1*a* by a scanning optical system 1*b*, and the reflected light thereof is imaged on a CCD 1*d* through a reduction lens 1*c* and is photoelectrically converted. Next, this image information is A/D-converted, and thereafter is forwarded to a memory.

Next, sheet feeding is effected from the feeding portion 3. Sheet feed cassettes 3*a* and 3*b* containing therein sheets S of different sizes are removably mounted on the lower portion of the copier. The sheet feeding operation from the upper sheet feed cassette 3*a* will hereinafter be described because the sheet feeding operations from the two cassettes are similar to each other.

FIG. 1 is a diagram representing the conveyed positions of the leading edge and trailing edge of the sheet relative to time in the present embodiment, and the axis of abscissas plots time, and the axis of ordinates plots distance. Thus, the inclination of lines represents the conveying speed. The sheet feeding is effected by the pickup roller 3*c* being rotatively driven by a solenoid connected thereto being turned on/off at predetermined intervals. Even if a plurality of sheets S are picked up, when they are nipped between the conveying roller 3*e* and the retard roller 3*f*, only the uppermost sheet is fed by the retard roller 3*f* driven in the direction opposite to the conveying direction through a torque limiter, not shown, and double feeding does not take place. The sheet thus picked up is conveyed to the registration rollers 20 at the same speed 250 mm/s as the image forming speed by the conveying rollers 22.

Next, the fed sheet S passes a registration roller upstream side sensor 2*k* and thereafter arrives at the registration rollers 20. The registration rollers 20 are comprised of a pair of driving roller 20*a* and driven roller 20*b* biased by a spring.

The driving roller 20*a* comprises a metallic mandrel and rubber secured to the outer periphery thereof, and the driven roller 20*b* is formed of a metal of which the outer peripheral surface roughness is small. The driving roller 20*a* receives driving from a stepping motor, shown in a box labeled—STEPPING MOTOR—, and the speed control thereof is possible by the controller 100 of the main body. When the leading edge of the sheet S strikes against the registration rollers 20, the registration rollers 20 are stopped, and after the leading edge is detected by the registration roller upstream side sensor 2*k*, the registration rollers 20 are driven at a peripheral speed of 500 mm/s at predetermined timing t1.

Figure 2:
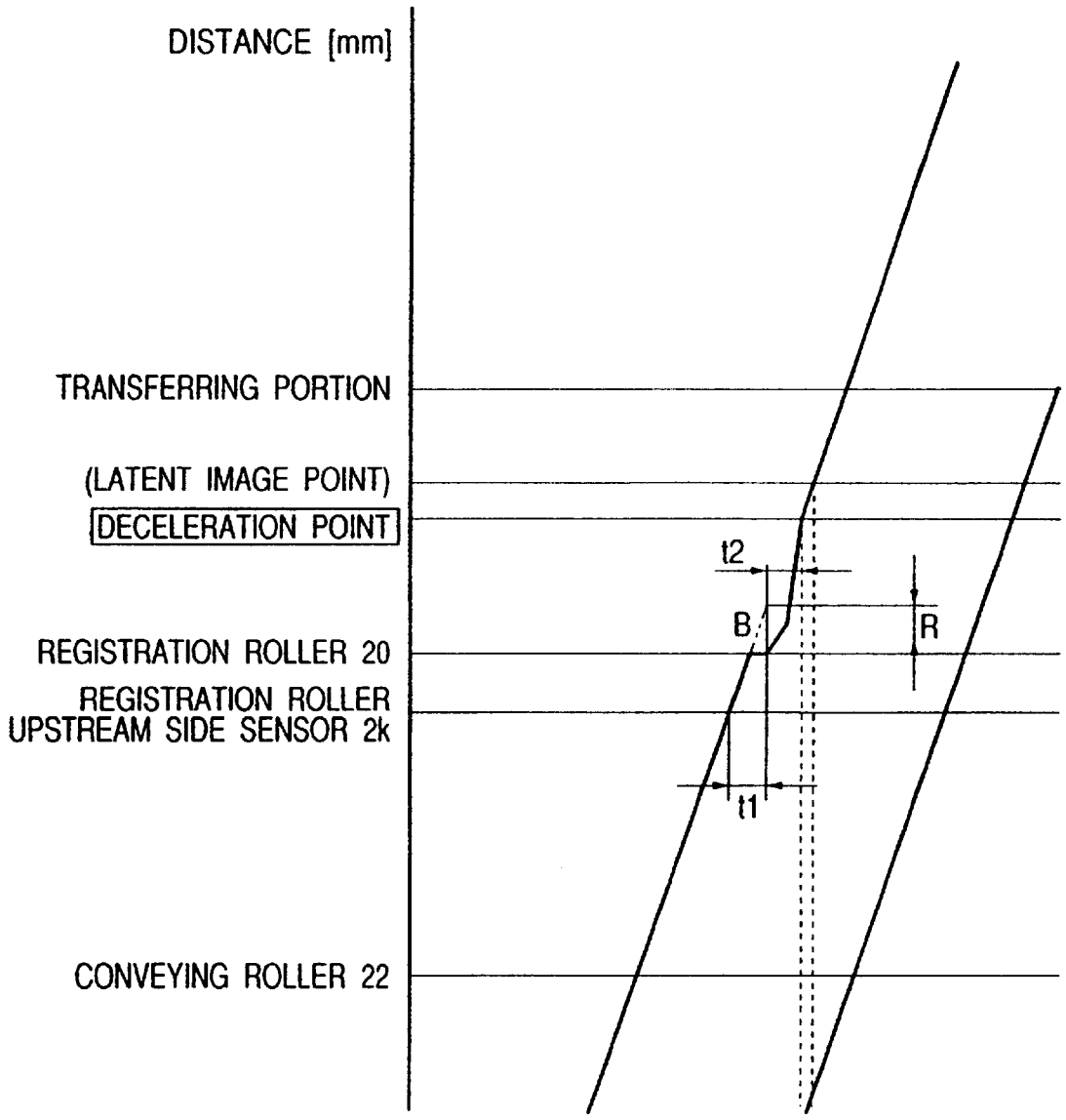
FIG. 2 is an enlarged diagram of the portion around the registration rollers of FIG. 1.

FIG. 2 is an enlarged diagram representing the position of the sheet around the registration rollers, and dot-and-dash line B is a movement graph to be fed by the conveying rollers 22 and therefore, the distance R is the amount of push-in by the conveying rollers 22 during the stoppage of the registration rollers. The sheet S is made to follow the registration rollers by the rigidity of the paper by this amount of push-in, and the correction of the skew feeding of the sheet S is effected.

Alter the sheet of which the skew feeding has been corrected is conveyed by the registration rollers 20, the conveying speed of the registration rollers 20 is decelerated to the same speed 250 mm/s as the image forming speed at predetermined timing t2. At that time, the sheet also meshes with the conveying rollers 22 and therefore, the conveying speed must likewise be decelerated to 250 mm/s or less. The conveying rollers 22 receive driving by a stepping motor discrete from that for the registration rollers 20 and also, the speed control thereof is made possible by the controller 100.

By the above-described control, there is secured a time for the registration roller upstream side sensor 2*k* to be capable of detecting the leading and trailing edges of the sheet even on this side of the registration rollers 20 between which the sheet interval becomes narrowest.

Figure 4A:
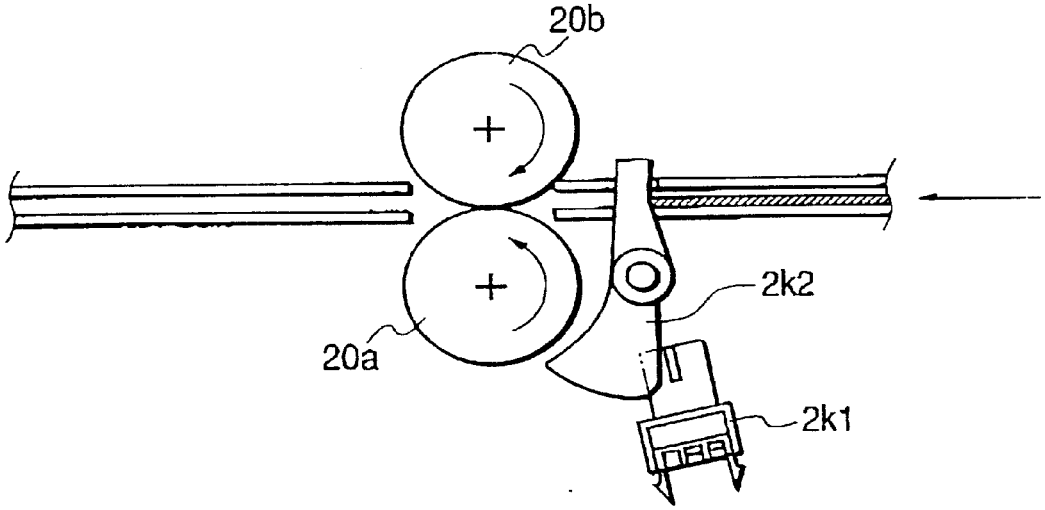
FIGS. 4A and 4B are detailed views of the registration rollers upstream side sensor of FIG. 1.
Figure 4B:
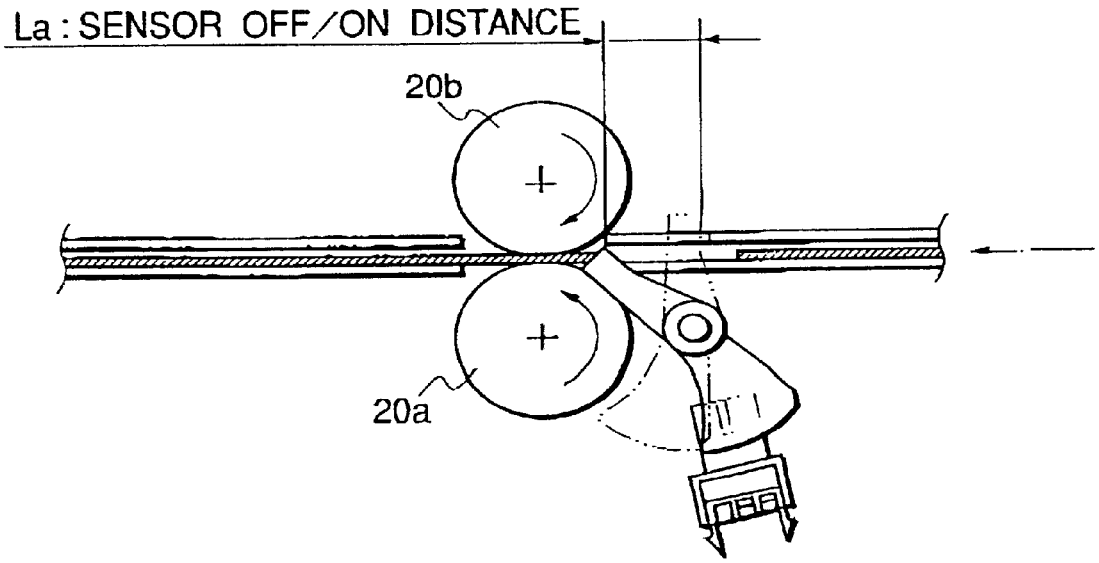

The registration roller upstream side sensor 2*k* is designed such that when a sheet is present on the sensor, a lever 2*k*2 shields a photointerrupter 2*k*1 from light as shown in FIG. 4A, and when a sheet is absent on the sensor, the lever 2*k*2 escapes from the photointerrupter 2*k*1 by the biasing force of a spring, not shown, as shown in FIG. 4B. Consequently, care must be taken of the fact that when the sheet interval becomes shorter than the sensor OFF/ON distance La, the detection of the sheet becomes impossible.

Next, turning back to FIG. 3, a description will be made of the image forming means 2. On the basis of the image information read by the already described reader portion 1 and stored in the memory, a laser beam emitting portion 2*a* emits a laser beam, which is scanned in the direction of the bus line of a photosensitive drum 2*c* by the rotation of a polygon mirror 2*b*, whereby a latent image is formed on the surface of the photosensitive drum 2*c* charged in advance by a charger 2*d*. This latent image is developed by a developing device 2*e* provided around the photosensitive drum 2*c*, and a toner image is formed on the sheet S conveyed by a pair of transferring upstream rollers, by a transferring charger 2*g*. Any residual toner on the surface of the drum after the image transfer is removed by a cleaning device 2*h*.

Here, as shown in FIG. 3, the distance L' from the registration rollers 20 to a transferring point is arranged so as to satisfy a relation L≦L' with respect to the distance L from a latent image point to the transferring point. Thus, latent image formation is effected after a predetermined time has certainly elapsed from the ON of the driving of the registration rollers 20.

Generally, it is not during steady rotation, but during the rising and falling of a motor that the vibration of the motor becomes maximum. Accordingly, the moment when the vibration of the motor for driving the registration rollers 20 becomes maximum precedes the latent image formation by a predetermined time, and the color misregistration or the change in the color tone of an image can be reduced without the vibration affecting the latent image formation.

Also, in a case where as described above, the registration rollers 20 are driven at 500 mm/s and thereafter, is decelerated to the same 250 mm/s as the image forming speed, the timing at which the registration rollers are driven at 500 mm/s and the timing at which the registration rollers are decelerated to 250 mm/s can both be controlled so that the distance from the registration rollers 20 may be within the range of L'–L. By such controlling, the vibration during the rising and falling of the motor for driving the registration rollers does not affect the latent image formation.

Further, the controller 100 as the sheet conveyance controlling means controls so that as to quicken the sheet deceleration timing of the roller arranged at a more upstream side regarding the conveying rollers nipping the sheet when the sheet is rammed against the registration rollers 20.

That is, during the stoppage of the registration rollers 20, the conveying rollers 22 also nip the trailing edge of the sheet S therebetween and therefore, there exists the timing at which the sheet S is nipped by two sets of rollers, i.e., the registration rollers 20 and the conveying rollers 22.

Generally in such a case, the conveying rollers 22 must be decelerated at the same timing or earlier in accordance with the deceleration timing of the registration rollers 20. This is because if the deceleration timing of the conveying rollers 22 is made later than the deceleration timing of the registration rollers 20, there will be a time during which the conveying speed of the conveying rollers 22 is higher than that of the registration rollers 20 and as the result, the push-in amount of the conveying rollers 22 will increase and the influence of wrinkles, image misregistration, etc. will come out at the image transferring point.

The deceleration timing of the registration rollers 20 is earlier than the latent image forming timing and therefore, if the deceleration timing of the conveying rollers 22 is made equal to that of the registration rollers 20, the influence of the vibration of the motor for driving the conveying rollers 22 upon the latent image formation can also be reduced. However, in order to further reduce the influence of the vibration, in the present embodiment, the deceleration timing of the conveying rollers 22 is made earlier than the deceleration timing of the registration rollers 20. Thereby, the moment when the vibration of the motor for driving the registration rollers 20 becomes maximum and the moment when the vibration of the motor for driving the conveying rollers 22 becomes maximum deviate from each other and thus, the influence of the vibration upon the latent image formation can be further decreased.

Also, it is not only the conveying rollers 22 that the deceleration timing is deviated relative to the registration rollers 20. In the case of a large size sheet such as A3 sheet or long size sheet, even rollers more upstream than the conveying rollers 22 may nip the sheet therebetween. Again in such case, the deceleration timing of the more upstream rollers is made earlier little-by-little, whereby the timing when the vibration of all motors for driving the rollers nipping the sheet becomes maximum is deviated little-by-little, and the misregistration or the like of the image by the vibration can be effectively reduced.

Thereafter, the sheet S to which the toner image has been transferred in the image forming means 2 is directed to the fixing portion 4 by a conveying belt 8, and when it passes between a pair of fixing rollers 4*a* and 4*b*, heat and pressure are applied thereto to thereby fuse the toner image onto the sheet S. The sheet S after the fixing of the image is discharged out of the apparatus through a pair of discharge rollers 5*a* and 5*b*.

It will be seen that by the embodiment described above in detail, there is obtained the effect that during the latent image formation in the image forming means 2, the possibility of the vibration by the driving or stoppage of the registration rollers 20 and the conveying rollers 22 located upstream thereof shifting onto the latent image to thereby affect the color misregistration or the like of the image can be reduced.

A one-way clutch for locking in the sheet conveying direction may be provided on the driving shaft of the conveying rollers 22. Thereby, the stepping motors for the registration rollers 20 and the conveying rollers 22 can be made common.

After the sheet S is nipped/between the registration rollers 20, the driving of the conveying rollers 22 is rendered OFF and the sheet S is pulled in the direction of idle rotation of the one-way clutch by the registration rollers 20, whereby the sheet conveyance similar to that in the first embodiment can be accomplished by a simple construction.

(Second Embodiment)

Figure 5:
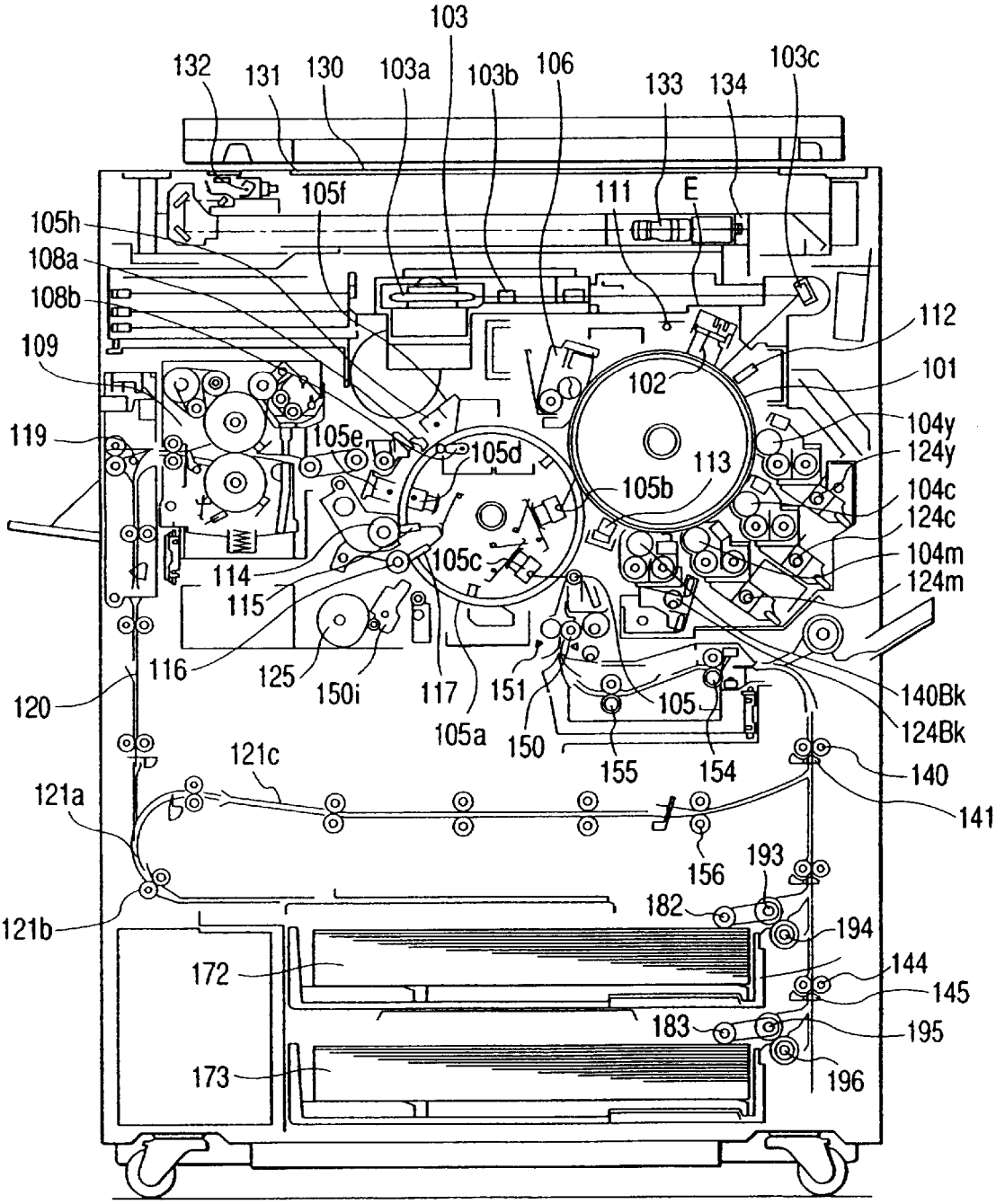
FIG. 5 shows the general construction of an image forming apparatus according to a second embodiment of the present invention.
Figure 6:
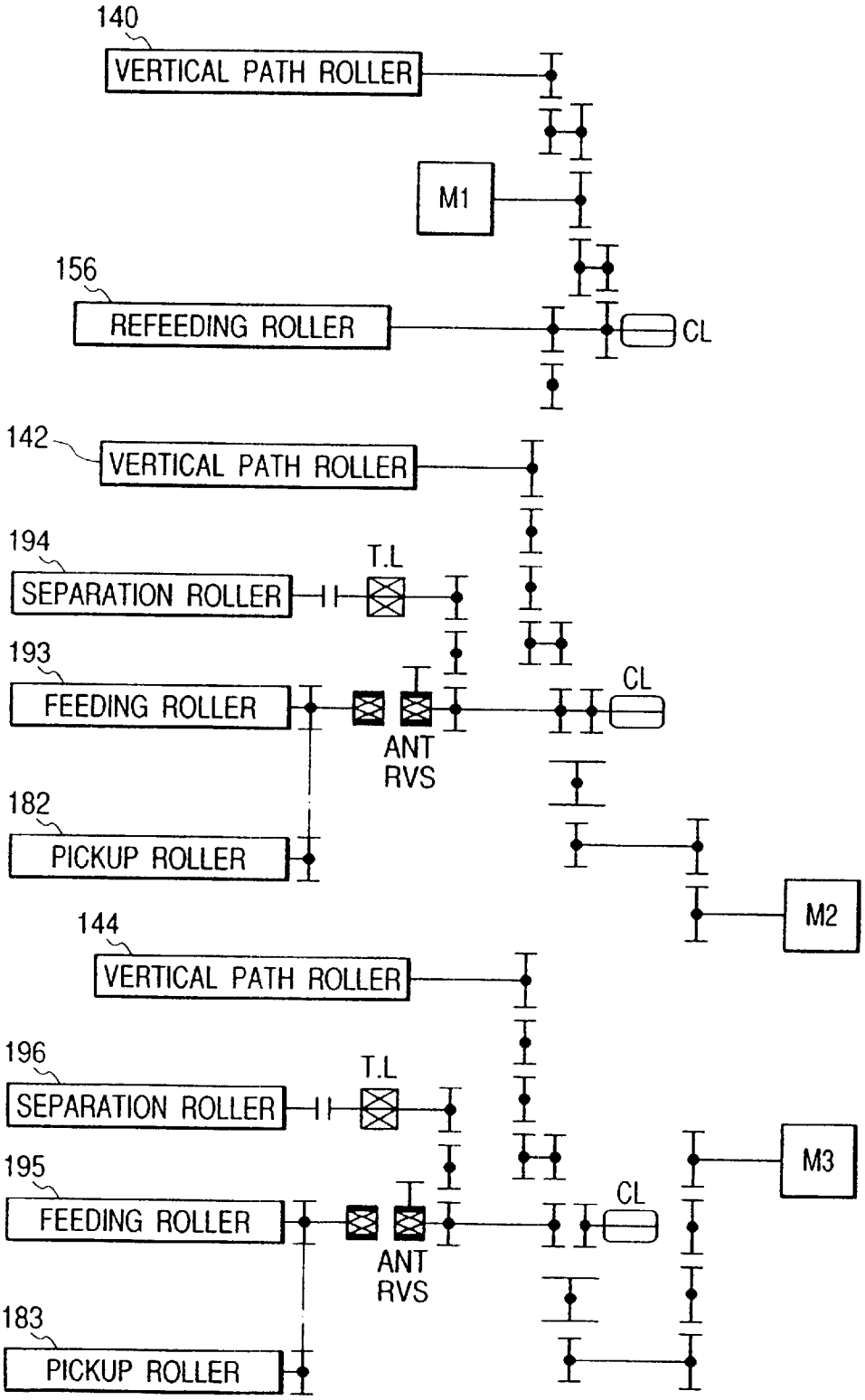
FIG. 6 is a developed view of the driving of the feeding portion and vertical path conveying portion of the image forming apparatus shown in FIG. 5.
Figure 7:
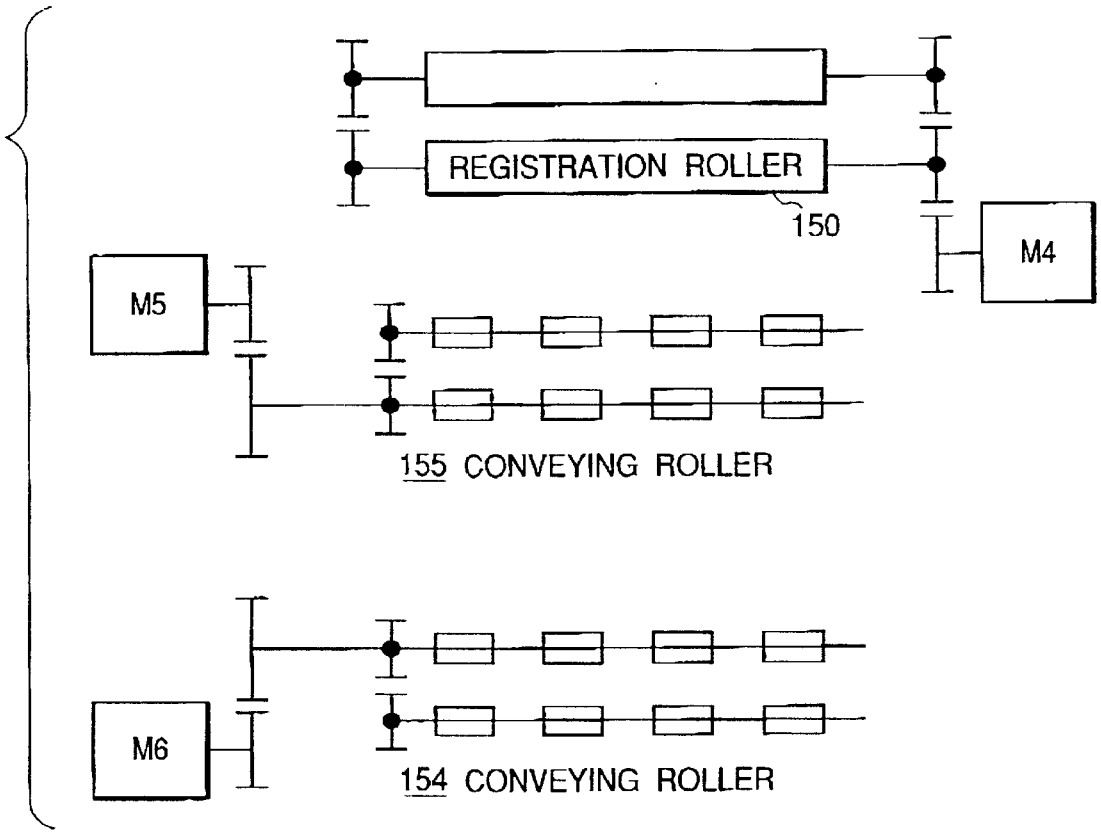
FIG. 7 is a developed view of the driving of the conveying portion of the image forming apparatus shown in FIG. 5.
Figure 8:
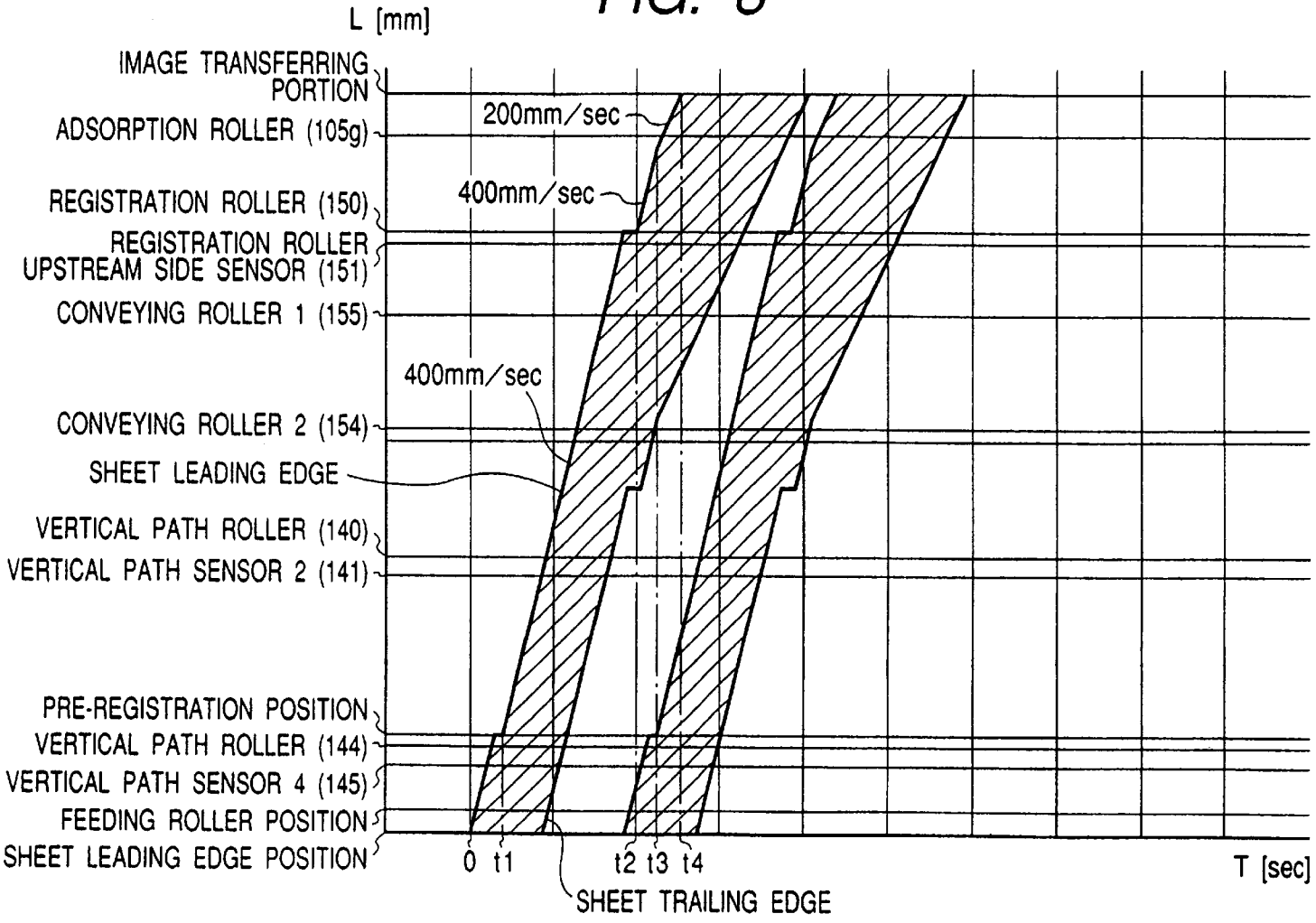
FIG. 8 is a sequence diagram during the conveyance in the second embodiment.
Figure 9:
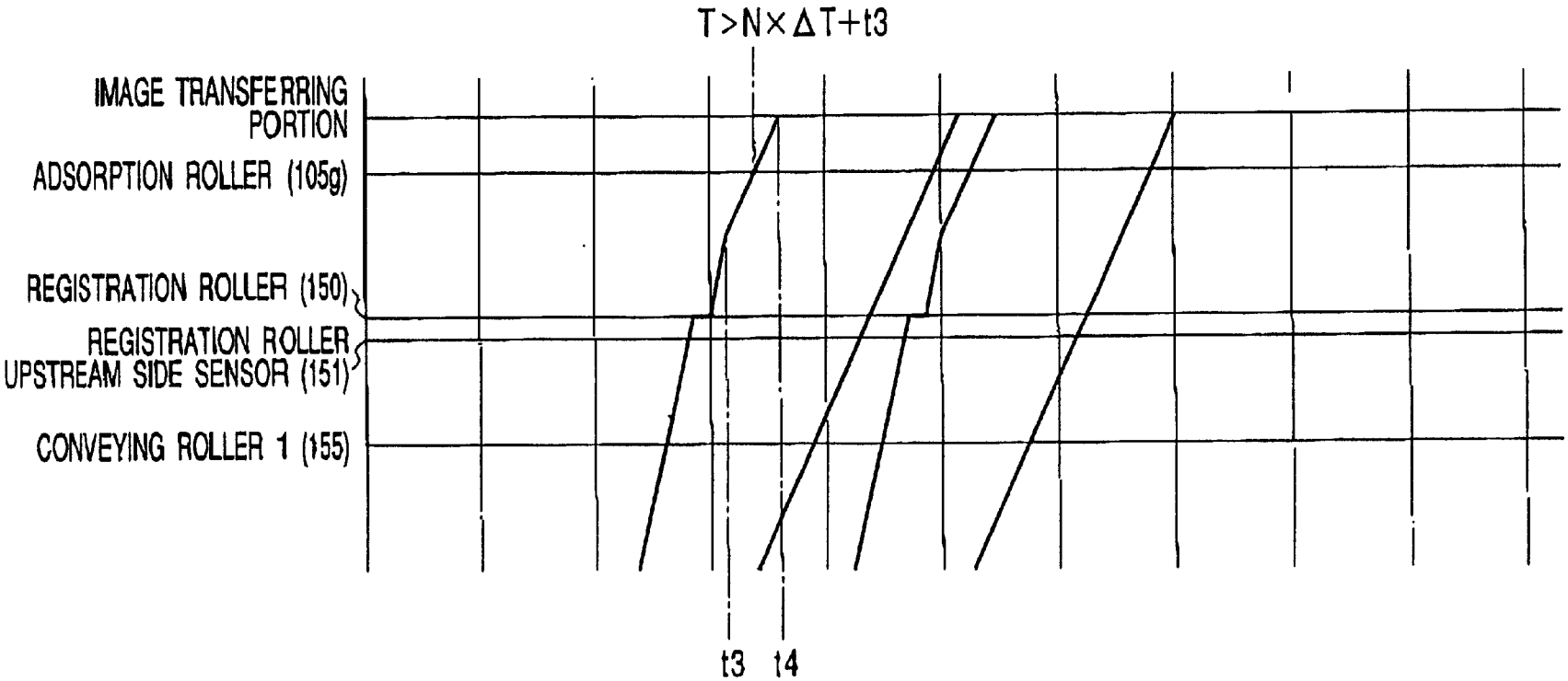
FIG. 9 is a detailed view regarding registration rollers in the sequence diagram shown in FIG. 8.

A second embodiment of the image forming apparatus according to the present invention will now be described. FIG. 5 shows the general construction of the image forming apparatus, FIG. 6 is a developed view of the driving of a feeding portion and a vertical path conveying portion, FIG. 7 is a developed view of the driving of a conveying portion, FIG. 8 is a sequence diagram during the conveyance in the present embodiment, and FIG. 9 is a detailed view regarding registration rollers in the sequence diagram shown in FIG. 8. Description will first be made of the main construction of the image forming apparatus for forming an image on a sheet and the function thereof.

(Image Forming Apparatus)

Referring to FIG. 5, the image forming apparatus according to the present embodiment is a full color electrophotographic copier having an image reading portion for reading the image of an original in the upper portion thereof, and image forming means for forming an image on a sheet in the lower portion thereof. In the image reading portion, an original 130 is placed on the original glass stand 131, and is exposed to light and scanned by an exposure lamp 132. The reflected light image from the original 130 is condensed on a full color CCD sensor 134 through a lens 133 to thereby obtain a color resolved image signal. The color resolved image signal is processed by a video processing unit, not shown, via an amplifying circuit, not shown, and is delivered to the image forming means.

In the image forming means, a photosensitive drum 101 which is the image forming means is rotatably supported, and around the photosensitive drum 101, there are disposed a pre-exposure lamp 111, a corona charger 102, a laser exposing optical system 103, a potential sensor 112, four developing devices 104 differing in color, i.e., a yellow developing device 104*y*, a cyan developing device 104*c*, a magenta developing device 104*m* and a black developing device 104B*k*, means 113 for detecting the quantity of light on the photosensitive drum, transferring means 105 and a cleaning device 106. An image signal delivered from the image reading portion in the laser exposing optical system 103 is converted into an optical signal by a laser outputting portion, not shown, and the laser beam converted into the optical signal is reflected by a polygon mirror 103*a*, and is projected onto the surface of the photosensitive drum 101 through a lens 103*b* and via a mirror 103*c*.

During image formation, the photosensitive drum 101 is rotated, and the photosensitive drum 101 after charges have been eliminated therefrom by the pre-exposure lamp 111 is uniformly charged by the charger 102, and an optical image E is applied thereto for each resolved color to thereby form a latent image. Next, predetermined one of the developing devices is operated to thereby develop the latent image on the photosensitive drum 101, whereby an image of a toner consisting of resin and a pigment as the base is formed on the photosensitive drum 101. The developing devices are adapted to be alternatively moved toward the photosensitive drum 101 in conformity with respective resolved colors by the operation of eccentric cams 124*y*, 124*c*, 124*m* and 124B*k*.

Further, the toner images on the photosensitive drum 101 are transferred to a sheet supplied from a sheet cassette 172 or 173 through a conveying path and an adsorption roller 105*g* to transferring means to a position opposed to the photosensitive drum 101. The transferring means, in the present embodiment, has a transferring drum 105*a*, a transferring charger 105*b*, an adsorbing charger 105*c* for electrostatically adsorbing the sheet, the adsorption roller 105*g* opposed thereto, an inner charger 105*d* and an outer charger 105*e*, and a sheet carrying sheet 105*f* formed of a dielectric material is cylindrically and integrally extended over the opening area of the peripheral surface of the transferring drum 105*a* journalled so as to be rotatively driven. In the present embodiment, a dielectric material sheet such as polycarbonate film is used as the sheet carrying sheet 105*f*.

In accordance with the rotation of the transferring drum 105*a*, the toner images on the photosensitive drum 101 are transferred onto a sheet carried on the sheet carrying sheet 105*f* by the transferring charger 105*b*. In this manner, a desired number of color images are superimposedly transferred onto the sheet, whereby a full color image is formed. When the transfer of the toner images is completed, the sheet is separated from the transferring drum 105*a* by the action of a separation claw 108*a*, a separation push-up roller 108*b* and a separation charger 105*h*, and is discharged onto a discharge tray 110 through a heat roller fixing device 109. After the transfer, the photosensitive drum 101 has any residual toners on its surface removed by a cleaning device 106, and thereafter is used again for the image forming process.

When images are to be formed on both sides of the sheet, immediately after the sheet has passed through the fixing device 109, a conveying path changeover guide 119 is driven to thereby once guide the sheet to a reversing path 121*a* via a conveying vertical path 120, whereafter by the reverse rotation of a reversing roller 121*b*, the sheet is made to leave in a direction opposite to the direction in which it has been fed in, with the trailing edge when it has been fed in as the head, and goes toward a both-side conveying path 121*c*. Thereafter, the sheet is again fed from refeeding rollers 156 to the image forming means, and by the above-described image forming process, an image is formed on the other surface of the sheet. Also, the transferring drum 105*a* is provided with a fur brush 114 and an oil removing roller 116, and backup brushes 115 and 117 opposed to these are disposed with the sheet carrying sheet 105*f* interposed therebetween. The sheet carrying sheet 105*f* is cleaned by these to thereby remove powder such as scattered and adhering toners, oil, etc., and prevent these from adhering to the sheet. Such cleaning is effected before or after the image formation, and is effected at any time when jam occurs.

Also, in the present embodiment, there is adopted a construction in which an eccentric cam 125 is rotatively operated to actuate a cam follower 105*i* made integral with the transferring drum 105*a*, whereby the gap between the sheet carrying sheet 105*f* and the photosensitive drum 101 can be set arbitrarily, and except during the image formation, the transferring drum 105*a* and the photosensitive drum 101 are operated so as to be spaced apart from each other.

A sensor, not shown, for detecting the reference of the image position is disposed in the transferring drum 105*a*, and when at the start of image formation, the transferring drum 105*a* is pressed against the photosensitive drum 101, the transferring drum 105*a* receives driving from the rotating photosensitive drum 101 and begins to be rotated, and when the rotation thereof is substantially stabilized (after about ⅓ rotation), control means, not shown, is set at such a position for just transmitting a signal. This image signal reference signal (hereinafter referred to as the Itop signal) is regularly transmitted for each one full rotation of the transferring drum, and on the basis of this signal, all operations of the apparatus such as the reading of the original and the conveyance of the sheet are performed. The control means governs the control of the image forming apparatus, and further effects the control of a sheet conveying apparatus hereinafter described.

Here, the sheet conveying apparatus centering about registration rollers according to the present embodiment will be described in detail with reference to the sequence diagram and each developed view of driving. In the present embodiment, as shown in FIG. 6, a vertical path roller 140 and a refeeding roller 156 are driven by a stepping motor M1, a pickup roller 182, a feeding roller 193 and a separation roller 194 are driven by a stepping motor M2, and a pickup roller 183, a feeding roller 195 and a separation roller 196 are driven by a stepping motor M3. Thereby the changeover construction for the speed of each roller can be simplified, and the sheet can be conveyed to the registration rollers with high conveyance accuracy.

Also, likewise, as shown in FIG. 7, the registration rollers 150 and conveying rollers 154 and 155 which are conveying means are driven by independent stepping motors M4, M5 and M6, respectively. Thereby, like feeding and driving, a changeover construction for speed can be simplified, and the sheet can be conveyed to the registration rollers with high conveyance accuracy.

First, after the start of image formation, for example, the feeding motor M1 begins to be rotated with the above-mentioned Itop signal (this being the time axis 0) as the reference, and the pickup roller 183 is rotated to thereby perform the sheet pickup operation, and next the separation and conveyance of the sheet are effected by the feeding roller 195 and the separation roller 196. The leading edge of the sheet is detected by a sensor 145 in the vertical path, whereafter the conveyance of the sheet is once stopped with the vertical path rollers 144 nipping the leading edge of the sheet (this stopping operation will hereinafter be referred to as the pre-registering operation). Also, likewise when the sheet is refed from the both-side conveying path 121*c*, the leading edge of the sheet fed from the refeeding roller 156 is detected by a vertical path sensor 141, whereafter the pre-registration operation is performed by the vertical path roller 140.

Thereafter, shift is made to the next conveying operation after the lapse of a predetermined time t1 (see FIG. 8) from the Itop signal. Since the restart of conveyance is done with the Itop signal as the reference, the correction of the positional and time deviation in the conveyance direction of the sheet during pickup and separation can be effected by this pre-registration operation. In the present embodiment, the conveying speed of the sheet during the pickup and during the restart after the pre-registration operation is set to a numerical value of 400 mm/sec. This is because the separating capability of a feeding unit having a pickup roller 183 and a separating roller 196 is the reference and in the case of a numerical value higher than this, the remarkably short life of the feeding rollers 195 will result or the separation of the sheet will become difficult, and in some cases, the double feeding of sheets will result.

Until a predetermined time t2 (see FIG. 8) elapses from the Itop signal after the leading edge of the sheet is detected by the registration roller upstream side sensor 151 via conveying rollers 154 and 155 after the sheet conveying operation is restarted after the pre-registration operation, the leading edge of the sheet is held at the registration rollers 150 and the conveyance of the sheet is temporarily stopped. Thereby a loop is formed in the sheet and the skew feeding of the sheet is corrected and also, the loop is temporarily held to thereby adjust the next conveying timing. Then, the registration rollers 150 again starts the conveyance of the sheet at a speed of 400 mm/sec.

At a position before the leading edge of the sheet comes to the nip portion of the adsorption roller 105*g*, i.e., after the lapse of a time t3 (see FIGS. 8 and 9) from the Itop signal, the sheet conveying speed of the registration rollers is decelerated to a speed (in the present embodiment, 200 mm/sec.) substantially equal to the image forming speed. By doing so, the vibration or the like of the sheet or the driving system or the like during the deceleration of the sheet conveying speed can be prevented from affecting the adsorption roller 105*g* and the transferring drum 105*a*.

At this time, the upstream conveying rollers 154 and 155 are also decelerated in succession from the roller near to the registration rollers 150 with a time Δt staggered with the signal during the deceleration of the registration rollers 150 as the reference. This time Δt is an interval at which the driving pulses of the stepping motors M4 and M6 for the registration rollers 150 and the conveying rollers 154, 155 do not cause resonance, and specifically is staggered by several times as much as the driving pulse of the stepping motors plus ½ pulse. Thereby the vibration during the deceleration can be made small without the pulse motors resonating.

By adopting such a construction that the vibration or the like during the deceleration does not affect image formation, good image formation can be accomplished. In the case of a plurality of driving motors, if the setting is not to ½ pulse, but is such that the driving pulses of the respective motors do not overlap one another and cause resonance, an equal effect can be obtained Also, when the number of conveying rollers including the registration rollers 150 during the decelerating operation is N, the timing of deceleration is set such that even after the lapse of N×Δt+t3 (sec.) from the Itop signal, the leading edge of the sheet does not arrive at the adsorption roller 105*g* or the transferring drum 105*a*, whereby the influence of the vibration of the pulse motors propagated through the sheet upon the transferring drum 105*a* can be eliminated and the rotation of the transferring drum 105*a* is more stabilized, and better image formation can be accomplished.

Also, since the deceleration takes place in succession from the roller near to the registration rollers 150, mutual pulling between the conveying rollers for the sheet does not occur, nor damage to the sheet, the power swing of the stepping motors for driving the conveying rollers and the slip of the sheet relative to the conveying rollers occur and the operation can be very much stabilized.

The sheet is then electrostatically adsorbed to the transferring drum 105*a* and is conveyed on the transferring drum 105*a* at a speed (in the present embodiment, 200 mm/sec.) equal to the image forming speed, and the transfer of the image is started after the lapse of a time t4 from the Itop signal. In the present embodiment, the time t4 when the Itop signal is 0 is made substantially coincident with the time until the image written onto the photosensitive drum 101 in conformity with the Itop signal by the laser is developed with a toner and the formed toner image comes to the transferring position.

When in the present embodiment, the sheet is to be laterally fed, it is possible to stick two sheets on the periphery of the transferring drum 105*a*, and the sequence diagram of FIG. 8 uses LTR lateral feeding as the model. At this time, during the conveyance of an odd sheet, conveyance can be effected with the Itop signal sent for each one full rotation of the transferring drum 105*a* intactly used as the reference, and during the conveyance of an even sheet, the same operation can be started with a delay of just a half round of the transferring drum from the Itop signal the preceding sheet has used as the conveyance reference. Thereby, in the case of any of the odd sheet and the even sheet, the leading edge of the sheet arrives at the transferring means after the lapse of the time t4 from the start of feeding.

Also, when a sheet of a large size such as A3 or LDR paper is to be conveyed, it is possible to stick only one sheet on the transferring drum and therefore, the feeding of the sheet can always be started with the Itop signal as the reference. That is, in any case, the sheet can be conveyed with the time t4 from after this Itop signal or the Itop signal plus a half round of the transferring drum as the target.

Also, in the present embodiment, as described above, the feeding speed of 400 mm/sec. is selected with the separating capability taken into account, and this is also a speed at which the conveyance from the sheet cassette 173 farthest from the transferring means is just in time during the time t4 from the Itop signal. Even if the sheet is fed more rapidly to the image transferring position, it is meaningless because the important image formation is not in time. Accordingly, when for example, a sheet is to be conveyed from the sheet cassette 172 nearer to the transferring means, the time for starting the pickup of the sheet is delayed aiming at the same time t4, whereby afterwards, feeding and conveyance control at entirely the same timing and speed can be effected.

Also, a case where the sheet is conveyed to the registration roller portion with a delay (delay) or a case where it arrives there early (early arrival) would occur to mind, but as described above, the registration rollers 150 stop the leading edge of the sheet and form and maintain the loop thereof until the time t2 elapses. Thereby the leading edge of the sheet is adjusted so as to arrive at the transferring means after the lapse of the time t4 from the Itop signal, and the conveyance is not affected.

While in the present embodiment, the feeding and conveying operation has been described as being performed with the Itop signal produced from the transferring drum 105*a* for each one full rotation thereof as the reference, the feeding and conveying operation can also be performed with a signal produced from the image reading portion for each reading, a signal produced with the image position information in the image forming means or the intermediate transferring member as the reference, or a clock signal or the like always produced at predetermined intervals as the reference, to thereby obtain a similar effect.

(Third Embodiment)

Figure 10:
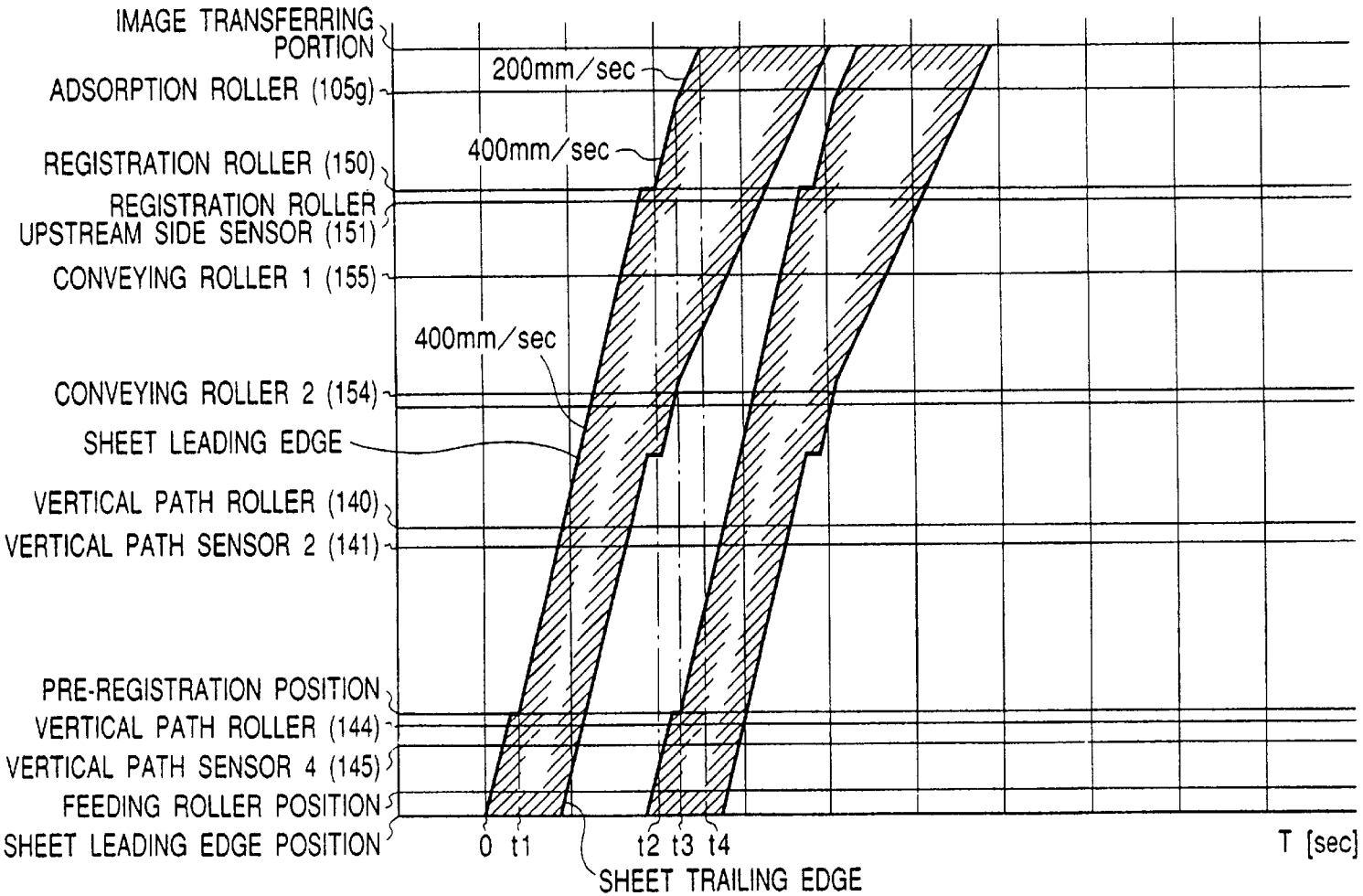
FIG. 10 is a sequence diagram during the conveyance in a third embodiment.

A third embodiment of the image forming apparatus according to the present invention will now be described. FIG. 10 is a sequence diagram during the conveyance in the present embodiment, and FIG. 11 is a detailed diagram regarding the registration roller of the sequence diagram shown in FIG. 10, and portions overlapping those in the description of the second embodiment are given the same reference characters and need not be described.

In the above-described second embodiment, a description has been made of the control of stopping the upstream side conveying rollers 154 and 155 and maintaining the loop during the preparation of the loop for the correction of the skew feeding of the sheet at the registration rollers 150, and effecting the timing adjustment as well. In the present embodiment, however, a description will be made of a case for effecting the control of a loop maintaining time 0 in which the upstream side conveying rollers 154 and 155 are not stopped during the formation of the loop at the registration rollers 150, that is, the leading edge of the sheet is rammed against the stopped registration rollers 150, whereafter the rotation of the rollers upstream thereof is stopped, and without the loop being once maintained, the rotation of the registration rollers 150 is started. To render the loop maintaining time into 0, it is most often the case that exposure for image formation is effected after the conveyance of the sheet has been started from the registration rollers 150. In the present embodiment, a description will be made with an image forming apparatus of such an arrangement taken as an example.

As in the second embodiment, a sheet is fed and separated from the feeding portion, and after the restart after the pre-registration operation, it has its leading edge detected by the registration roller upstream side sensor 151 via the conveying rollers 154 and 155. Then, after the lapse of a predetermined time t2 from the Itop signal, i.e., after the leading edge of the sheet is held at the registration rollers 150 to thereby form a loop which can correct the skew feeding of the sheet, the rollers upstream of the registration rollers 150 are not stopped, but the rotation of the registration rollers 150 is started. Thereby, the sheet starts to be conveyed again at a speed of 400 mm/sec.

Figure 11:
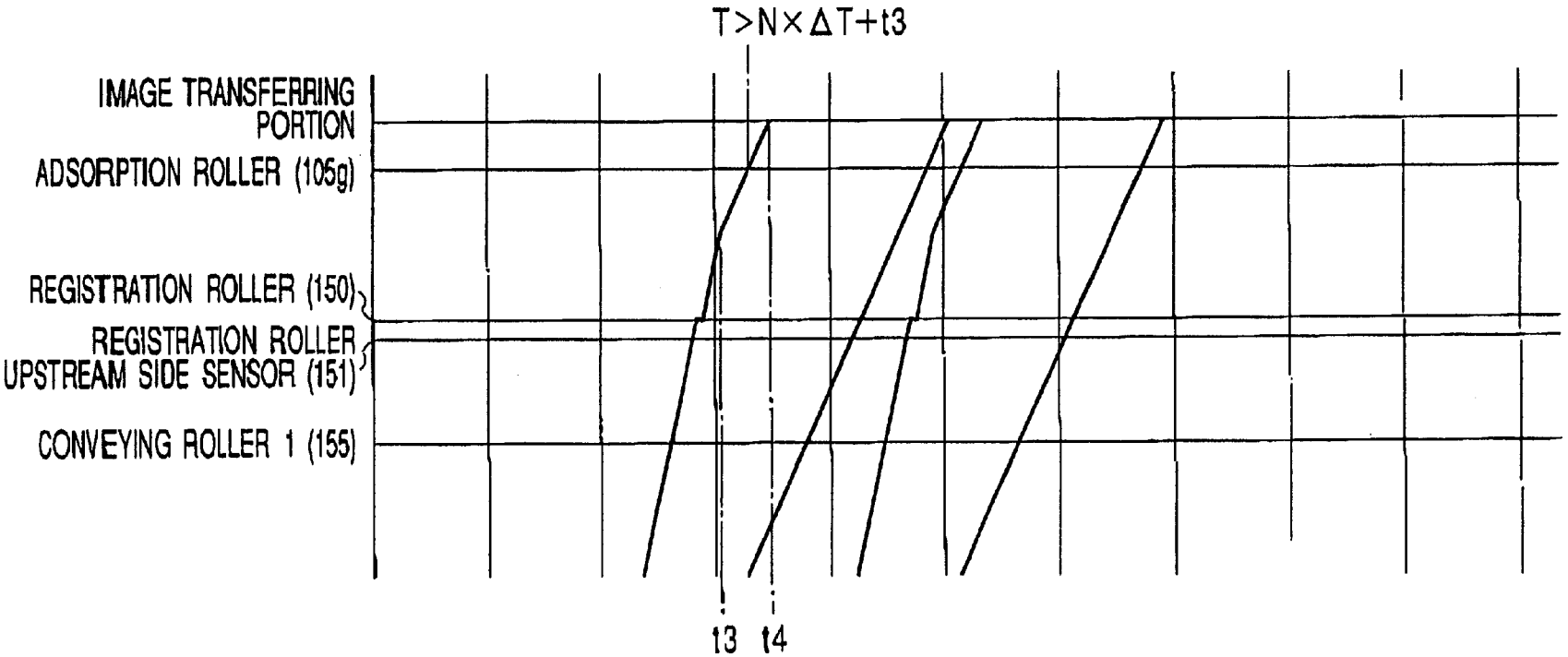
FIG. 11 is a detailed view regarding registration rollers in the sequence diagram shown in FIG. 10.

At this time, as shown in FIGS. 10 and 11, the upstream conveying rollers are not stopped but are effecting conveyance at the speed of 400 mm/sec. and thus, the loop maintaining time is 0, and the Fcot of the apparatus can be made shorter by an amount corresponding to the loop maintaining time than in the prior art. Again this case is entirely similar to the case of the second embodiment, and design is made such that deceleration ends before the leading edge of the sheet after passed between the registration rollers 150 arrives at the transferring means, whereby the speed fluctuation of the sheet and the vibration of the stepping motors do not affect the image forming means and therefore, good image formation can be accomplished.

While in the present embodiment, the sheet conveying speed of the registration rollers 150 after the formation of the loop is made higher than the image forming speed, it does not always become a premise from the viewpoint of rendering the loop maintaining time into 0 to thereby improve throughput that during the rotation of the registration rollers, the sheet conveying speed is made higher than the image forming speed. To the last, the loop maintaining time is made short (made zero as the utmost limit), whereby it becomes possible to improve the throughput as compared with the apparatuses according to the prior art. In addition to such control, the registration rollers convey the sheet at a speed higher than the image forming speed, whereby it becomes possible to achieve a further improvement in the throughput.

When the sheet conveying speed of the registration rollers after the formation of the loop is made substantially equal to the image forming speed, it is necessary that as soon as the rotation of the registration rollers is started, the upstream side conveying rollers which have so far conveyed the sheet at a speed higher than the image forming speed be also decelerated to the speed substantially equal to the image forming speed.

Also, in the present embodiment, exposure is effected after the conveyance by the registration rollers 150 has been started and therefore, transfer is possible without the positions of the image and the sheet deviating relative to each other. However, in the case of an image forming apparatus of a type in which exposure is effected before the conveyance by the registration rollers 150 is started, and conveyance is effected with the position of the sheet and the position of the image brought into coincidence with each other and likewise, the control of the loop maintaining time 0 is effected, design is also made such that deceleration ends before the leading edge of the sheet arrives at the transferring means, whereby an entirely similar effect can be obtained.

As described above with a plurality of embodiments taken as examples, design is made such that the deceleration of the registration rollers ends before the sheet arrives at the transferring means, whereby the vibration of the sheet by the deceleration and the vibration or the like of the pulse motors propagated through the sheet can be prevented from being transmitted to the transferring means. Accordingly, the uneven pitch of the apparatus due to the vibration or the like of the image can be prevented and good transferred images can be obtained.

Also, design is made such that the timing of the deceleration of the registration rollers and the conveying rollers is staggered by a predetermined minute time, whereby the vibration during the deceleration can be made small and likewise good images can be obtained. Particularly, by making the minute time into an interval at which the driving pulses of the stepping motors for the registration rollers and the conveying means do not cause resonance, it become possible to make the vibration still smaller.

Further, by rendering the loop maintaining time at the registration rollers into 0, the first copy time of the apparatus can be made shorter by an amount corresponding to the loop maintaining time than in the prior art.

Thus, it becomes possible to make the sheet conveying intervals at the transferring means infinitely small without causing a great increase in cost by the complication and bulkiness of the apparatus and an increase in parts, and the productivity of the image forming apparatus can be maximally obtained.

What is claimed is:

1. An image forming apparatus comprising:

image forming means for forming an image on a sheet;

separating and feeding means for feeding sheets stacked on sheet supporting means one-by-one toward said image forming means;

sheet conveying means for conveying the sheets fed by said separating and feeding means;

registration rollers of a variable rotating speed disposed upstream of said image forming means with respect to a sheet conveying direction; and sheet conveyance controlling means for causing said registration rollers to effect a conveyance of the sheets at a speed higher than an image forming speed in said image forming means, and thereafter decelerating said registration rollers so as to assume substantially a same speed as the image forming speed at a timing earlier than a latent image forming timing in said image forming means.

2. An image forming apparatus according to claim 1, further comprising an upstream registration roller, which is disposed upstream of a side sheet detecting means, which is disposed upstream of said registration rollers, wherein said sheet conveyance controlling means causes the conveyance of the sheets to be effected at the speed higher than the image forming speed at a predetermined sheet conveying timing after a detection of the sheets by said upstream registration roller.

3. An image forming apparatus according to claim 1, wherein said sheet conveyance controlling means makes a sheet deceleration timing of said sheet conveying means earlier than a sheet deceleration timing of said registration rollers.

4. An image forming apparatus according to claim 1, wherein said image forming means is arranged so as to satisfy the following relationship:

$$L \leqq L',$$

where L is the distance from a latent image point on a photosensitive drum to a transferring point, and L' is the distance from said registration rollers to the transferring point.

5. An image forming apparatus according to claim 1, wherein said registrations rollers include a pair of rollers, one of which is driven by a stepping motor.

6. An image forming apparatus comprising:

image forming means including a photosensitive drum and a transferring drum, which is provided in opposed relationship with said photosensitive drum, and which transfers a toner image formed on said photosensitive drum to a sheet wound around said transferring drum to thereby form an image on the sheet;

registration rollers disposed upstream of said transferring drum with respect to a sheet conveying direction, and capable of controlling a sheet conveying speed;

sheet conveying means disposed upstream of said registration rollers with respect to the sheet conveying direction;

said registration rollers effecting a conveyance of the sheet at a conveying speed higher than an image forming speed at which said image forming means conveys the sheet while forming an image on the sheet; and sheet conveyance controlling means for decelerating said registration rollers to said image forming speed before the sheet arrives at said transferring drum.

7. An image forming apparatus according to claim 6, wherein a sheet conveying speed of said sheet conveying means is decelerated after a lapse of a predetermined time from a start of a deceleration of said registration rollers.

8. An image forming apparatus according to claim 7, wherein said sheet conveying means includes a plurality of pairs of conveying rollers along the sheet conveying direction, and deceleration is performed at predetermined time intervals in succession from the pair of conveying rollers proximate to said registration rollers.

9. An image forming apparatus according to claim 8, wherein the predetermined time intervals are intervals at which driving pulses of stepping motors for said registration rollers and said sheet conveying means do not cause resonance.

10. An image forming apparatus according to claim 6, wherein said registration rollers, include a pair of rollers one of which is driven by a stepping motor, and said sheet conveying means is driven by a stepping motor.

11. An image forming apparatus according to claim 6, wherein when a correction of a skew feeding of the sheet is to be effected at said registration rollers, said sheet conveying means does not perform an operation of stopping a conveyance of the sheet, and after a loop for a correction of the skew feeding has been formed, a time for maintaining said loop is rendered into zero, and the sheet conveying speed at said registration rollers when said registration rollers start the conveyance is set to a speed substantially equal to the sheet conveying speed of said sheet conveying means.

* * * * *

UNITED STATES PATENT AND TRADEMARK OFFICE

CERTIFICATE OF CORRECTION

PATENT NO. : 6,529,703 B2
DATED : March 4, 2003
INVENTOR(S) : Ryoichi Kawasumi et al.

It is certified that error appears in the above-identified patent and that said Letters Patent is hereby corrected as shown below:

Column 6,
Line 12, “such” should read -- such a --;
Line 39, “nipped/between” should read -- nipped between --; and
Line 55, “Description” should read -- A description --.

Column 7,
Line 23, “drum 101” should read -- drum 101, --; and
Line 24, “lamp 111” should read -- lamp 111, --.

Column 12,
Line 2, “after” should read -- after being --; and
Line 60, “become” should read -- becomes --.

Column 14,
Line 3, “in” should read -- in an --.

Signed and Sealed this

Thirtieth Day of September, 2003

JAMES E. ROGAN
*Director of the United States Patent and Trademark Office*